US005755050A

United States Patent [19]

Aiken

[11] Patent Number: 5,755,050

[45] Date of Patent: *May 26, 1998

[54] WEB DESIGN FOR CHANGEABLE SIGN

[76] Inventor: Robert B. Aiken, 11039 N. River Trail, Mequon, Wis. 53092

[ * ] Notice: The term of this patent shall not extend beyond the expiration date of Pat. No. 5,410,830.

[21] Appl. No.: 646,003

[22] Filed: May 7, 1996

Related U.S. Application Data

[63] Continuation of Ser. No. 123,365, Sep. 17, 1993, abandoned.

[51] Int. Cl.[6] ..... G09F 11/18

[52] U.S. Cl. ..... 40/518; 40/471; 40/575

[58] Field of Search ..... 40/471, 518, 519, 40/520, 521, 522, 523, 574, 576

[56] References Cited

U.S. PATENT DOCUMENTS

| | | | |
|---|---|---|---|
| 3,426,461 | 2/1969 | Miller | 40/471 |
| 3,496,664 | 2/1970 | Gaffney et al. . | |
| 3,510,973 | 5/1970 | Mazzocco, Sr. | 40/471 |
| 3,780,458 | 12/1973 | Jacoby et al. . | |
| 4,680,883 | 7/1987 | Stadjuhar et al. | 40/471 |
| 4,741,118 | 5/1988 | Aiken et al. | 40/518 |
| 4,817,316 | 4/1989 | Walker | 40/576 |
| 5,072,533 | 12/1991 | Doepgen et al. . | |
| 5,174,055 | 12/1992 | Aken | 40/518 |

FOREIGN PATENT DOCUMENTS

| | | | |
|---|---|---|---|
| 1328806 | 7/1962 | France | 40/518 |
| 374243 | 6/1932 | United Kingdom | 40/518 |

*Primary Examiner*—Brian K. Green

*Attorney, Agent, or Firm*—Andrus, Sceales, Starke & Sawall

[57] ABSTRACT

A sign for selectively displaying a variety of information in a viewing window includes a web extending between a pair of spaced rollers and moveable by rolling and unrolling on the rollers. A base panel is releasably secured to a surface of the web. The base panel has an outer surface and an inner surface facing the web. Pockets are provided on the inner surface of the base panel for receiving the ends of display panels containing the information to be displayed in a viewing area of the sign. The pockets retain the display panels on the base panel while permitting relative movement therebetween as the web is rolled up and unrolled. The attachment of the base panels to the web also permits such relative movement.

13 Claims, 8 Drawing Sheets

FIG. 1
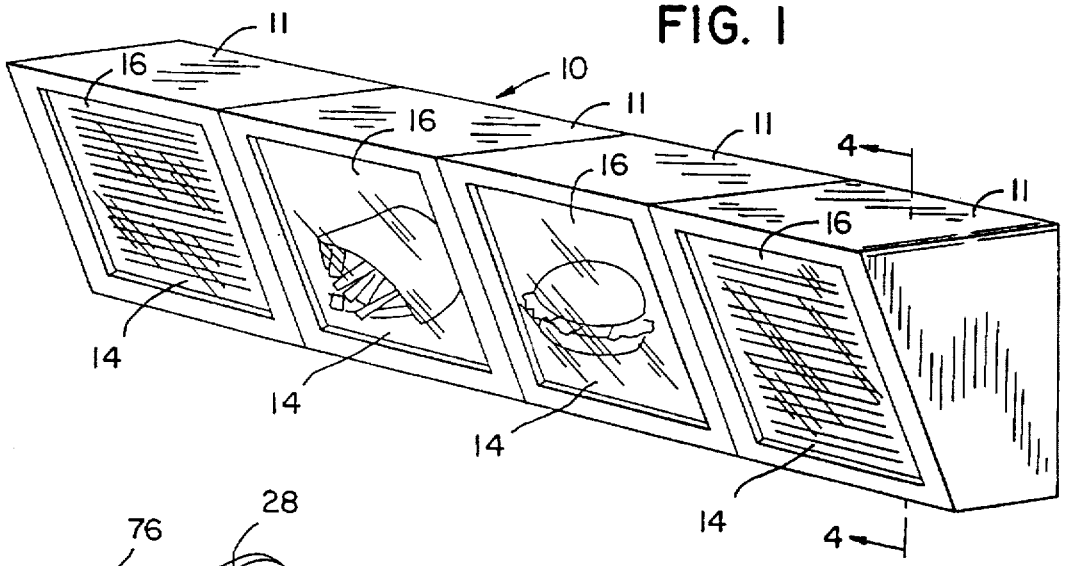
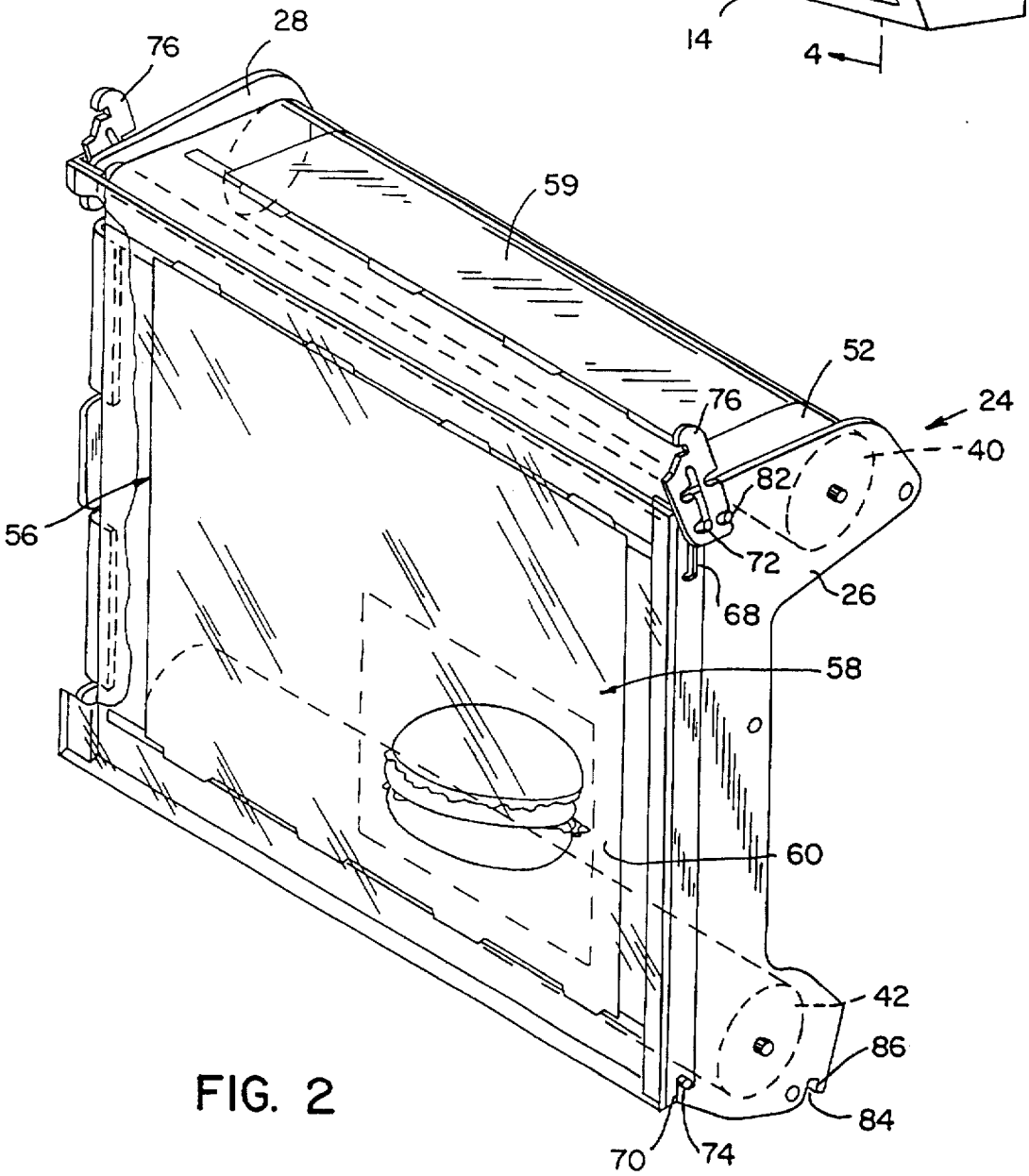
FIG. 2

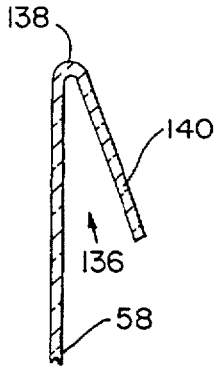
FIG. 10
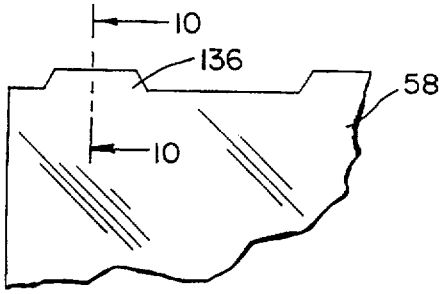
FIG. 9
FIG. 11
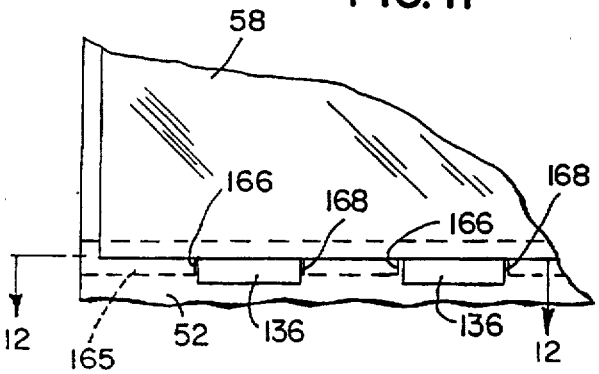
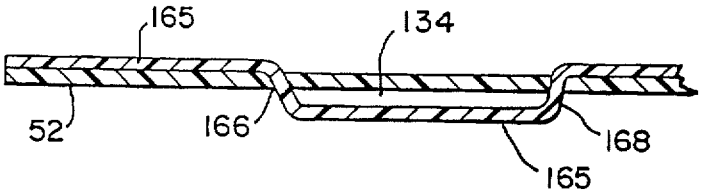
FIG. 12

WEB DESIGN FOR CHANGEABLE SIGN

The present application is a continuation application of U.S. patent application, Ser. No. 08/123,365, filed Sep. 17, 1993, and now abandoned.

BACKGROUND OF THE INVENTION

1. Field of the Invention

The subject invention relates to changeable signs in which graphic or textual information is displayed by moving a web containing the information across a viewing window in the sign. The invention is specifically directed to an improved web design in which the graphic or textual information is contained on removable panels mounted on the web.

2. Description of the Prior Art

There are numerous applications in which it is desirable to change the information displayed by a sign. Typical of such applications are signs involved in the advertising and merchandising of products as in fast food restaurants where menu items and prices are placed on "translate" panels that can be displayed in backlighted units located behind the counter. In such signs, it is often desired to change information regarding the availability of certain food items during the course of a day, to announce special or seasonal promotions, or for other reasons.

Prior art signs, such as menu boards and the like, typically use individual sheets for the graphics and individual characters or groups of characters for alpha-numeric information strips mounted on fixed panels. This makes changes difficult and time consuming, reducing the flexibility of the sign system.

More recently, changeable sign mechanisms have been employed to overcome many of the disadvantages of the prior art signs. A typical sign of this type is shown in U.S. Pat. No. 4,741,118 issued May 3, 1988 to the present inventor and others. In the sign there disclosed, the information is printed or coated on the web which is moved past a window in the sign. While such a sign permits the alpha-numeric information to be changed, the changes are limited to those permanently printed on the web. If additional changes are desired, it is necessary to change the web. This sign is particularly useful for gas stations and the like but cannot be readily adapted to a restaurant menu sign where frequent graphic and alpha-numeric changes are desired. Other examples of signs of this type are disclosed in U.S. Pat. Nos. 3,426,461; 4,680,883 and 3,496,664.

It is also known to provide information panels or sheets that may be removably mounted on a supporting web or strip, see for example, U.S. Pat. No. 3,510,973 to Mazzocco, Sr. and U.S. Pat. No. 3,780,458 to Jacobi, et al. The sheets or panels containing the information may be removably affixed to the strips by clips, pins or tape.

However, the two-ply web and information panel combination has created problems as the web is unwound from a supply roll and wound up on a take up roll. Slack develops in either the web or the panels because the web and panel have different radii when wound on the rolls. If the strip and panels are tight on the rolls, the slack appears in the viewing window as buckling, light leaks and other conditions detracting from the aesthetic features of the sign.

SUMMARY OF THE INVENTION

The present invention is directed to an improved web design for a changeable sign in which information panels are mounted on the web in an improved manner that permits the panels to move relative to the web as the web is wound on and unwound from the web rollers, maintaining the display or information panel in a flat, planar condition when in a viewing window while accommodating the differing radii of the web and the panel as it is rolled about the rollers.

In a preferred embodiment of the invention, the web has one or more base panels mounted on a surface of the web. The surface may be the front surface is that facing the window through which the sign is viewed. Each base panel has at least a pair of pockets that are transverse to the direction of movement of the web and spaced in the direction of movement of the web. The pockets are on the inside surface of the base panel, i.e. the surface of the base panel facing the surface of the web on which the base panels are mounted. The base panels may be mounted in seriatim along the web in its direction of movement between the rollers. The information or display panels are placed in the pockets and loosely retained in same. This permits the display panels to move relative to the base panel and the web in a direction parallel to the movement direction of the web. The display panels may be readily placed in and removed from the pockets, permitting a quick change-over of information displayed on the panels. The display panels may either contain graphic information or alpha-numeric information such as product descriptions, pricing, and the like which appears in a window of the sign through a transparent portion of the base panel.

The web and panels of the subject invention are adapted to be back-lighted to provide illuminated translite display panels identical in appearance to the current translite display panels displayed in the frame of existing display units while at the same time avoiding light leaks that detract from the aesthetics of the sign. To this end, the base panel may have opaque portions that overlap the display panels to prevent light leaks between the panels.

In a preferred embodiment, the web will contain a plurality of base panels, each mounting one or more display panels, wherein the specific base panel or display panel may be indexed into position by moving the web between the rollers.

In a preferred embodiment of the invention, the plurality of base panels are releasably secured to a surface of the web. The base panel may have hook-like fasteners that engage corresponding receivers on the web for releasably securing the base panel to the web in a manner that permits relative movement between the base panel and the web. The base panels may be readily mounted on and removed from the web so as to permit different display panels to be inserted in the pockets on the base panels to change the information displayed by the sign.

The present invention thus provides a changeable web configuration wherein the base panels and display panels are mounted in such a manner that they are free to move in a limited manner relative to each other and to the web to assure that the panels are in a flat, planar condition when in the viewing window, while permitting smooth winding and unwinding of the web from the web rollers by accommodating for the varying radii created the multiple layer web design.

Other objects and features of the subject invention will be readily apparent from the accompanying drawings and detailed description of the preferred embodiments.

BRIEF DESCRIPTION OF THE DRAWINGS

FIG. 1 is a perspective view of a menu display unit including a changeable web in accordance with the subject invention.

FIG. 2 is a perspective view of the changeable web and associated sign mechanism for use with the display unit of FIG. 1.

FIG. 9 is a fragmentary view of a base panel with integral mounting tabs.

FIG. 10 is a fragmentary section view taken generally along the line 10—10 of FIG. 9.

FIG. 11 is a fragmentary view looking generally in the same direction as FIG. 9, showing a base panel with an alternative means of securing the base panel to the web.

FIG. 12 is an enlarged fragmentary section view taken generally along the line 12—12 of FIG. 11.

DETAILED DESCRIPTION OF THE PREFERRED EMBODIMENTS

Figure 3:
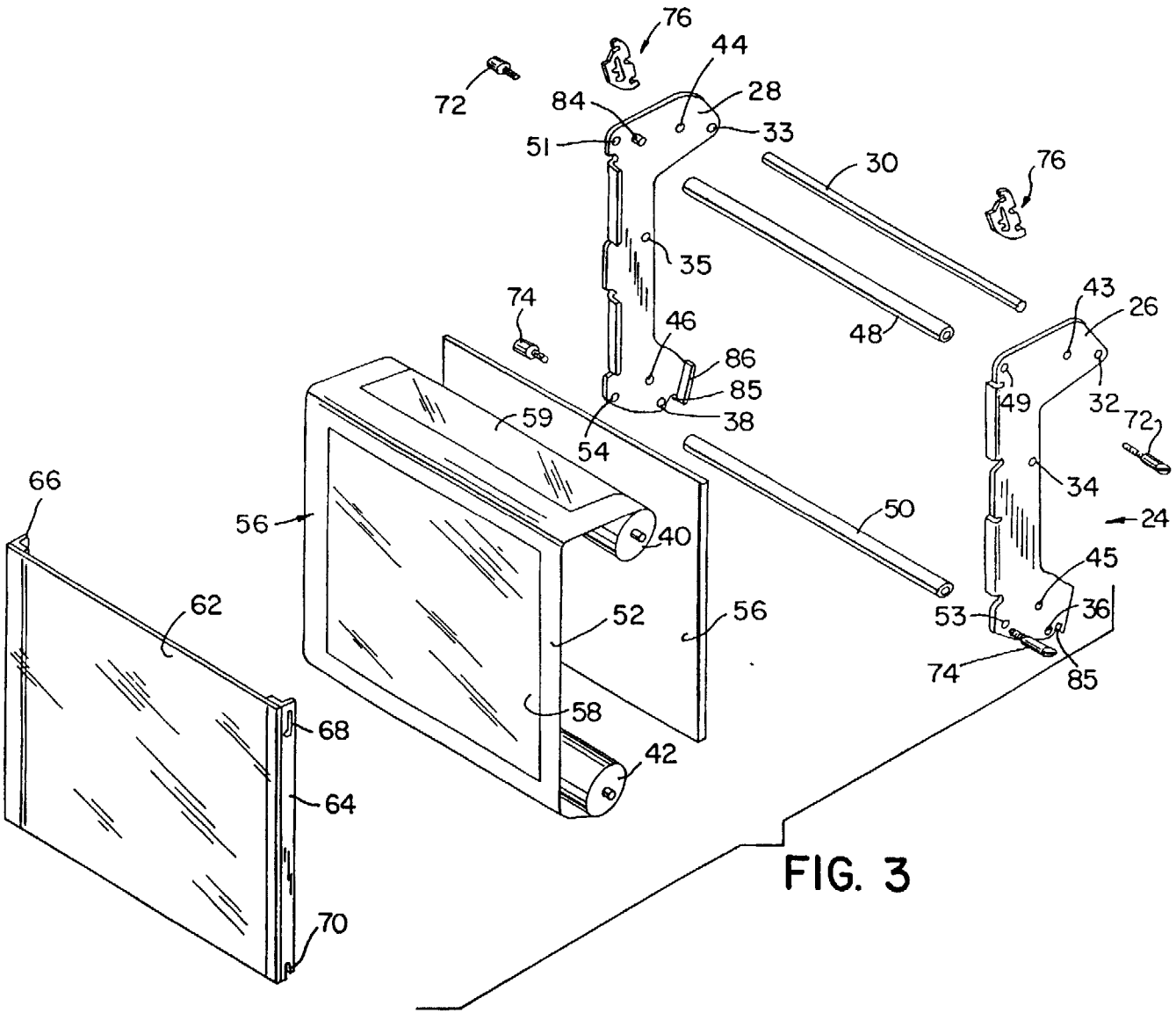
FIG. 3 is an exploded perspective view of the web and sign mechanism of FIG. 2.
Figure 4:
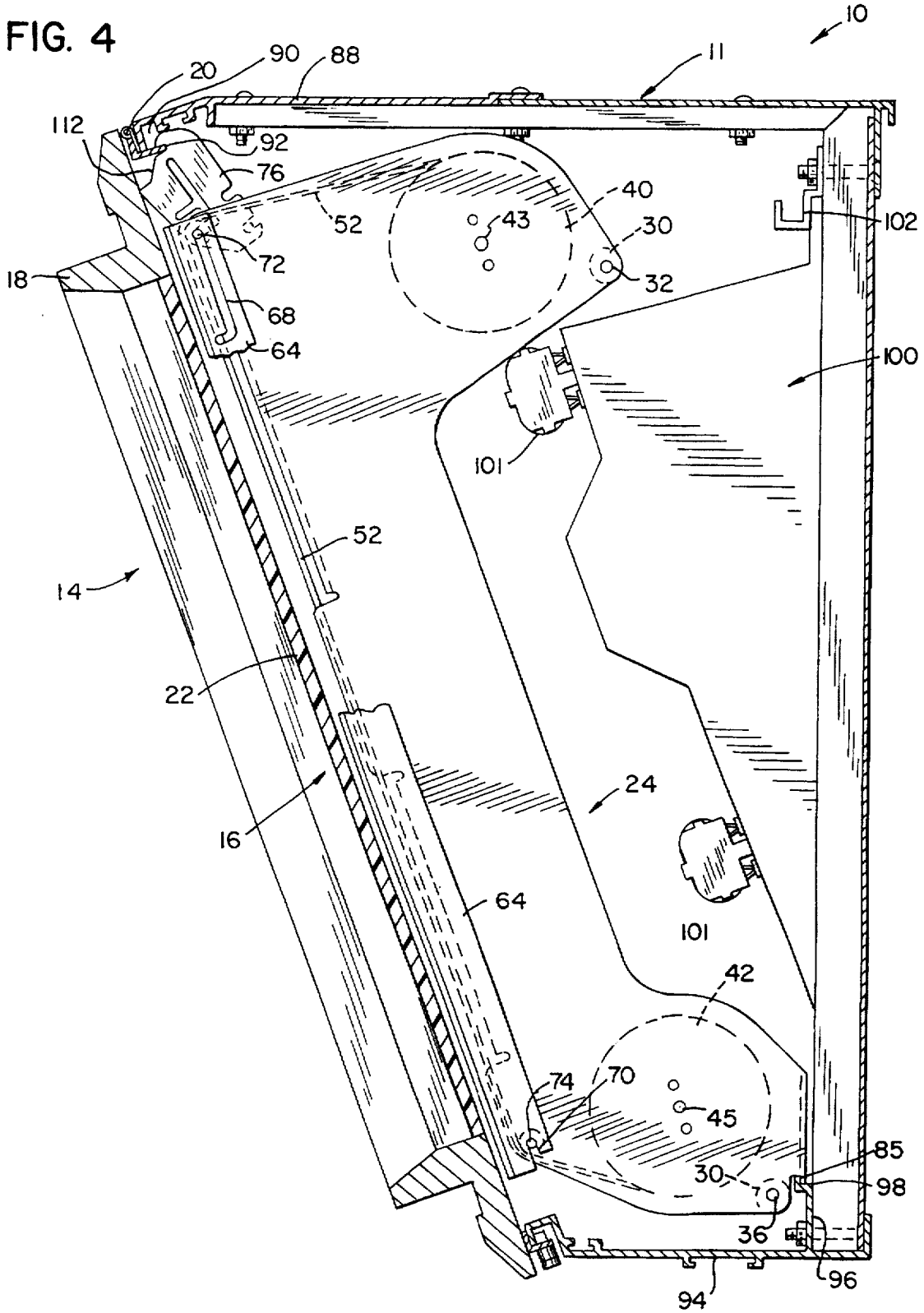
FIG. 4 is a section view taken generally along the line 4—4 of FIG. 1.

A display unit in which the improved web design of the present invention may be employed is shown in FIGS. 1–4 and is designated, in general, by the reference numeral 10. Typically, the display unit 10 includes at least one light box 11, having an enclosed frame with side walls for forming a box having an open front 14 providing a viewing area or window 16. As best shown in FIG. 4, the window typically includes a frame 18 hinged at 20 to the box 11 for defining the window 16. In most cases, each frame 18 includes a transparent panel 22 to protect the displayed material from the environment.

FIGS. 2 and 3 show a changeable sign mechanism 24 suitable for incorporation in display unit 10 and having outer side frames 26 and 28 secured in spaced apart parallel relationship with one another by a plurality of cross members such as, by way of example, the cross member 30 which is adapted to be received in receptive holes 32,33 on the respective side frames 26,28. In the preferred embodiment, two cross members 30 and two radiused cross members 48,50 are utilized and span the side frame members 26 and 28, with one cross member 30, mounted between holes 32,33 and a second cross member 30 mounted between holes 36,38, a radiused cross member 48, mounted between holes 49,51 and a second radiused cross member 50 mounted between holes 53,54. Radiused cross members 48 and 50 serve as guides for web 52 and mounting for light transmitting plate 56.

The assembled frames are adapted for receiving a pair of web rolls 40 and 42. The web roll 40 is mounted for rotation in through holes 43,44 on the respective side frames 26,28. The web roll 42 is mounted for rotation in the through holes 45,46 in the respective side frames.

An elongated, flexible web 52 has opposite ends secured to the rolls 40,42 and is guided over radiused cross members 48,50 and across the backing plate 56 (FIG. 3) which is adapted to be placed in position behind the window 16 of the display unit, as shown in FIG. 1. The web 52 includes a plurality of removable base panels 58,59 mounted thereon in a manner hereinafter described in detail, such that a selected one of said base panels and the associated display panels, also hereinafter described, may be positioned in the window 16 by advancing the web 52 past the window by rotating the rollers 40 and 42 in the appropriate direction.

A transparent cover panel 62 is mounted in a pair of subframe sections 64 and 66 (FIG. 3). As shown in FIG. 2, the subframe members are adapted to be secured to side frames 26 and 28 with shoulder bolts 72. Specifically, an elongated L-shaped slot is provided at the upper end of each frame section 64, 66 and a U-shaped open ended slot 70 is provided at the lower end. The threaded portions of shoulder bolts 72 pass through holes 49 and 51 and engage the threaded holes in the end of radiused cross member 48. The shoulder portion of each bolt is adapted to pass through slot 68. The threaded portions of shoulder bolts 74 pass through holes 53 and 54 and engage the threaded holes in the end of radiused cross member 50. The shoulder portion is adapted to be engaged by open ended slot 70. When transparent cover 62 is in the position shown in FIG. 2, it sandwiches the panel 58 on web 52 between the backing plate 56 and cover 62, assuring that the panel stays in a relatively flat condition when it is positioned in front of display window 16.

In the preferred embodiment, the web 52, base panels 58,59, the backing plate 56 and the light transmitting cover 62 are all made of a similar material such as, by way of example, the polycarbonate plastic sold under the trademark Lexan. It may be beneficial to coat the surfaces of the display surface 56 and transparent cover 62 in contact with the web 52 and base panels 58,59, with a transparent hardening compound to reduce scratching and marring of the surface of each of backing plate 56 and transparent cover 62 as the web 52 and base panels 58,59 move past.

A pair of universal mounting brackets 76 are mounted on the shoulders of shoulder bolts 72 and positioned outside subframe sections 64 and 66 as shown in FIG. 2 for mounting changeable sign mechanism 24 in display unit 10 in the manner shown in FIG. 4. The lower end of each frame member includes an opened U-shaped slot 85 and an extended tab 86 projecting at right angles from the frame member (FIG. 3). The brackets 76 are used in combination with the slot 85 and tabs 86 to mount the sign mechanism 24 in the display unit 11, including existing display units, thereby permitting retrofitting of existing units.

Figure 5:
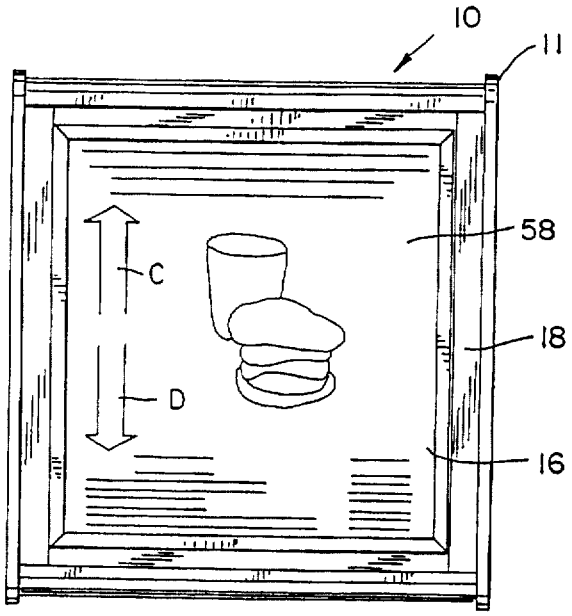
FIG. 5 is a view showing one front display frame of a display unit as shown in FIG. 1.
Figure 6:
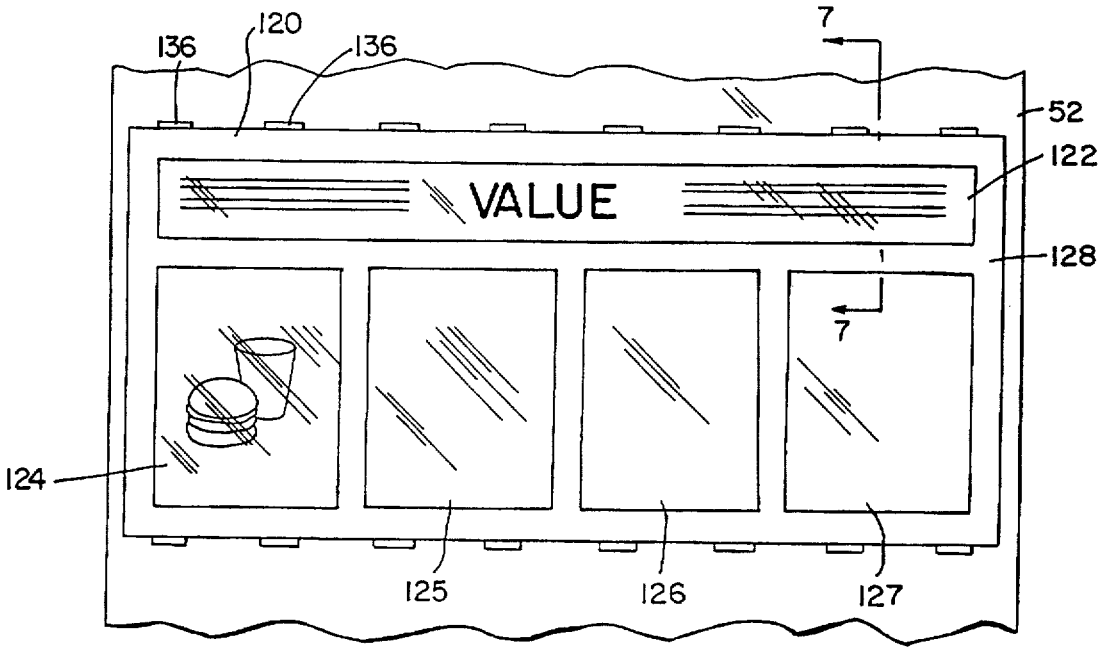
FIG. 6 is a fragmentary view of a changeable web having a base panel mounted thereon.

While the changeable menu board with changeable sign mechanism as shown in FIGS. 1–4 is adapted to be moved vertically past the viewing window 16 as indicated by the arrows C and D in FIG. 5, the subject invention may also be utilized to provide a changeable sign wherein the web is adapted to be moved horizontally past the window. In the embodiment of FIGS. 1–4, the web 52 and viewing window 16 are inclined relative to a vertical plane to enhance the display of the information panels in a typical installation. A typical installation includes illuminating means 100 to provide backlighting. It will be noted that illuminating means 100 is mounted with the light tubes 101 in parallel relationship with the plane of the viewing window 16 and the position of the web 52 in the window to assure uniform backlighting of the display.

FIGS. 6–13 show the improved design of the present invention for web 52. A base panel heretofore generally identified as 59, and now specifically identified as 120 defines a mounting panel for a plurality of display panels 122–127. Typically, the display panels include both alphanumeric information, as indicated in a header display panel 122 and graphic illustrations or the like as indicated in a plurality of individual display panels 124, 125, 126 and 127. When the improved design web is intended to be backlighted, the various display panels 122 and 124–127 are typically referred to as translite panels or "translites" and are made of clear or translucent polycarbonate plastic. They may include four-color printing to provide an aesthetically-pleasing display upon backlighting. Base panel 120 is generally of a translucent or substantially transparent material such as, by way of example, polycarbonate plastic as is the changeable web 52. Base panel 120 may include opaque borders 128 to frame the display panels, preventing light leaks and improving the display aesthetics.

Figure 7:
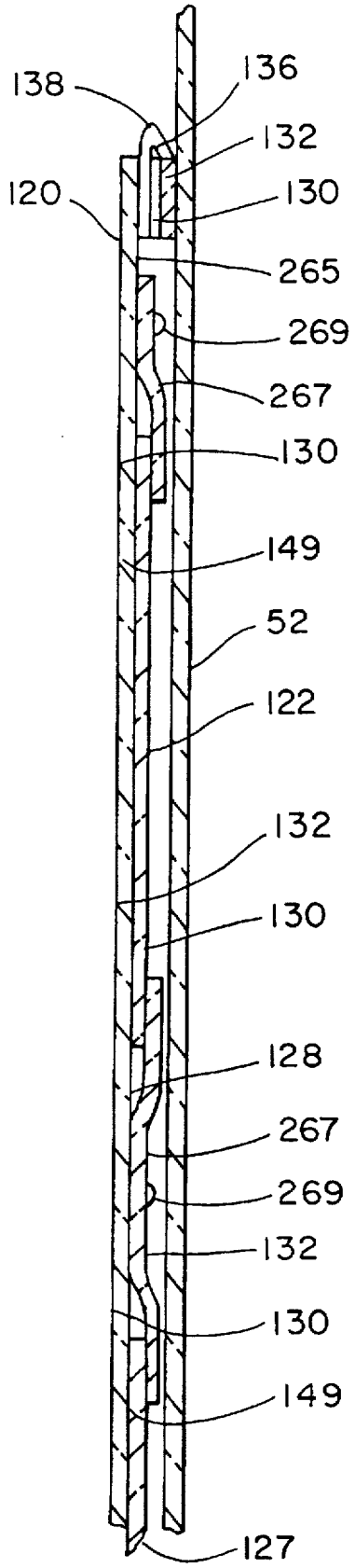
FIG. 7 is an enlarged section view taken along the line 7—7 of FIG. 6 showing the web, base panel, and display panel.

As is best shown in FIG. 7, the web 52 includes a plurality of mounting strips 130 mounted in spaced relationship along the direction of movement of the web and lying transverse to the direction of movement. The mounting strips 130 may be spaced outwardly from the web 52 by a plurality of elongated spacers 132, for defining mounting slots 134. The mounting strip 130 may be mounted on the web by use of double-backed adhesive tape, sonic welding, or by other means well known to those who are skilled in the art.

Base panel 120 includes a plurality of mounting tabs 136. As best shown in FIG. 7, the mounting tabs are creased at 138 to fold back over to form an inverted V or U-shaped member with the outer end 140 of the tab adapted to be inserted in the slot 134 for maintaining the base panel on the web. The aforesaid mounting arrangement removably retains base panel 120 on web 52 while allowing relative movement of the base panel and web when they are wound onto rolls 40 and 42. It also assures that the web and base panel will be in the flat planar condition across window 16.

Figure 8:
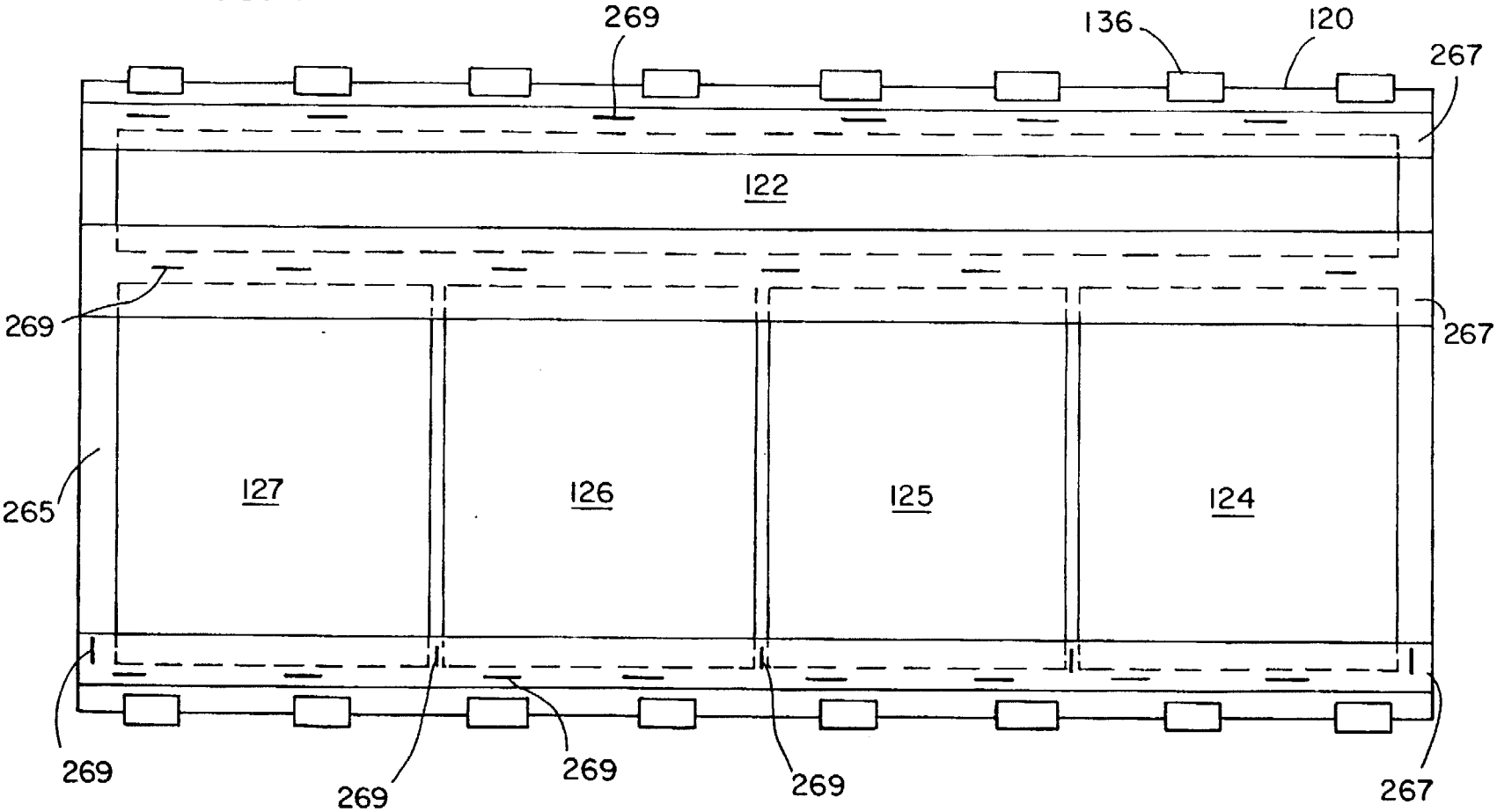
FIG. 8 is a view of the inner surface of a base panel showing the display panels mounted thereon.

Tabs 136 may be integrally formed with base panel 120, if desired, as shown in FIGS. 8 and 9.

As best shown in FIGS. 7 and 8, base panel 120 has the various translite panels 122 and 124–127 mounted on the inner surface 265 thereof. Inner surface 265 faces the surface of web 52 in which the base panels are mounted. The outer surface of base panel 120 appears in window 14 of display unit 10. Base panel 120 has a plurality of retaining means mounted on the inner surface for retaining display panels 122 and 124–127 on the inner surface. This retaining means may comprise strips of material 267 fastened on the inner surface that form pockets in which the ends of the display panels may be inserted. The strips are spaced in the direction of movement of base panel 120 and web 52. As shown in FIG. 8, the strips may be fastened to the inner surface of base panel 120 at the selected locations to form the pockets. The strips may be attached by mechanical fasteners such as staples 269, sonic or thermal welding, or adhesives, or adhesive tapes, etc. The display panels 122 and 124–127 are inserted in the pockets to retain them on the inner surface of base panel 120. The size of the pockets are such that the display panels may move relative to the base panel along the direction of movement of web 52 so as to avoid buckling of the base panel or display panels when rolled up on rolls 40 and 42. It also assures that the display panels are in a flat planar condition when in viewing window 14.

An alternative embodiment for mounting the base panels 120 on the web 52 is shown in FIGS. 11 and 12. As there shown, an elongate mounting strip 165 is mounted to the rear surface of the web 52 (FIG. 12) and fed through slots 166 and 168 provided through the web 52 for defining the mounting slots 134. The mounting tabs 136 on the panels 120 are inserted in the mounting slots so formed.

Figure 14:
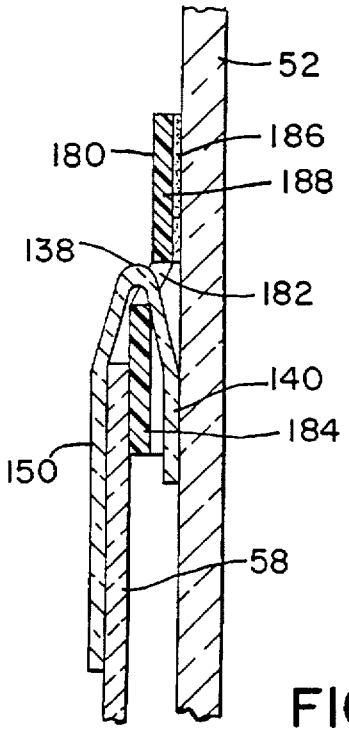
FIG. 14 is a fragmentary section view taken generally along the line 14—14 of FIG. 12.
Figure 13:
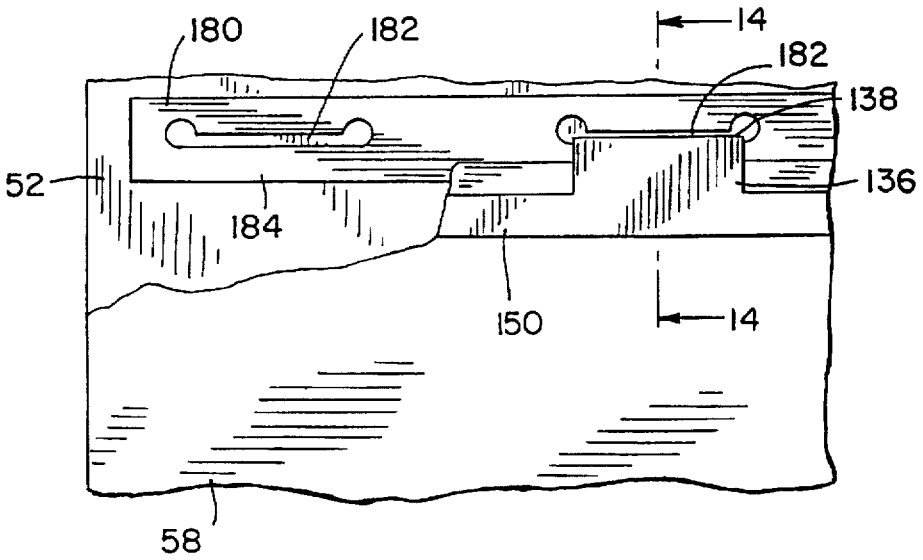
FIG. 13 is a fragmentary view looking in the same direction as FIG. 9, illustrating another embodiment for mounting a base panel on a web.

FIGS. 13,14 show a further means for mounting the base panels 120 on web 52. An elongated strip 180 may be attached to the web 52 in any suitable means such as, by way of example, sonic welding, adhesive or the like. The strip 180 includes a plurality of elongated through slots 182. As best shown in. FIG. 14, the lower edge 184 (as drawn) at the edge of the strip is free. A stripe of adhesive 186 secures the upper edge 188 of strip 180 directly to the surface of the web. The ends 140 of mounting tabs 136 may then be inserted in the slots 182 as shown in FIG. 14. A like strip 180 is adhesively attached to the web beneath the base panel 120 for receiving complementary mounting tabs attached to the lower edge of the base panel. The tabs 136 are free to move relative to the slot 182, permitting the base panel 120 to move relative to the web in a direction substantially parallel to the movement direction of the web, as in the previously described embodiments.

While certain features and embodiments of the invention have been described in detail herein, it will be understood that the invention includes all enhancements and modifications within the scope and spirit of the following claims.

What is claimed is:

1. Improved web apparatus for selectively displaying information while permitting ready change-over of the information being displayed, said web apparatus being suitable for use with a pair of spaced rollers, said web apparatus comprising:

an elongated flexible web having a direction of elongation, said web having ends suitable for attachment to said pair of spaced rollers so that a portion of the web may extend between the rollers when the web is so attached, the web being movable between the rollers by being unwound from one of the rollers and wound on the other of the rollers;

at least one display panel containing information to be displayed, said display panel having a pair of ends; and mount means on said web for positioning said display panel on said web, said mount means comprising at least one base panel having a pair of ends, said base panel having means for releasably securing each end of said base panel to a surface of the web with said base panel ends spaced along the direction of elongation of said web, said base panel being releasably secured in a manner such that each end of said base panel can move relative to said web along the direction of elongation of said web, the relative movement provided to said base panel with respect to said web being of an amount sufficient to allow the web apparatus to lie flat when displaying information and to allow the web apparatus to be smoothly curved when wound on a roller, said base panel having an outer surface away from the web and an inner surface facing said web, means on the inner surface of said base panel for retaining said ends of said display panel on said inner surface while permitting relative movement between each end of said display panel and said base panel along the direction of elongation of said web, the relative movement provided to said display panel with respect to said base panel being of an amount sufficient to allow the web apparatus to lie flat when displaying information and to allow the web apparatus to be smoothly curved when wound on a roller, said retaining means comprising pockets receiving the ends of said display panel, said pockets being formed of strips mounted on said inner surface of said base panel, said base panel overlying substantially all of said display panel when the display panel is retained on the inner surface of the base panel.

2. The web apparatus according to claim 1 wherein said strips of material extend across said base panel at intervals spaced along the direction of movement of said web.

3. The web apparatus according to claim 1 wherein said web apparatus comprises a plurality of retaining means mounted on said base panel and spaced in the line of movement of said web.

4. The web apparatus according to claim 1 wherein said base panel has hook-like tab means and wherein said web has corresponding receiving means for said tab means for releasably securing said base panel to the surface of said web.

5. The web apparatus according to claim 1 wherein said base panel has opaque portions surrounding said display panel when it is mounted on the base panel for avoiding light leaks between said display panel and said base panel.

6. The web apparatus according to claim 1 wherein said web, base panel, and display panel are formed of light transmitting material.

7. A sign for selectively displaying information while permitting ready change of the information being displayed, the sign comprising:

a pair of spaced rollers mounted in support means;

an elongated flexible web, one end of the web being attached to each of said rollers, a portion of the web extending between said rollers, said web having a line of movement between said rollers;

means for rotating the rollers for moving the web between the rollers as the web is unwound from one of said rollers and wound on the other of said rollers so as to change the portion of the web extending between the rollers;

at least one display panel containing information to be displayed, said display panel having a pair of ends; and mount means on said web for positioning said display panel on said web, said mount means comprising at least one base panel having a pair of ends, said base panel having means for releasably securing each end of said base panel to a surface of the web with said base panel ends spaced along the line of movement of said web, said base panel being releasably secured in a manner such that each end of said base panel can move relative to said web along the line of movement of the web the relative movement provided to said base panel with respect to said web being of an amount sufficient to allow the web apparatus to lie flat when displaying information and to allow the web apparatus to be smoothly curved when wound on a roller, said base panel having an outer surface and an inner surface facing said web, means on the inner surface of said base panel for retaining said ends of said display panel on said inner surface while permitting relative movement between each end of said display panel and said base panel along the line of movement of said web, the relative movement provided to said display panel with respect to said base panel being of an amount sufficient to allow the web apparatus to lie flat when displaying information and to allow the web apparatus to be smoothly curved when wound on a roller, said retaining means comprising pockets receiving the ends of said display panel, said pockets being formed of strips mounted on said inner surface of said base panel, said base panel overlying substantially all of said display panel when the display panel is retained on the inner surface of the base panel.

8. The sign according to claim 7, wherein said strips of material extend across said base panel at intervals spaced along the line of movement of said web.

9. The sign according to claim 7, wherein said sign includes a plurality of retaining means mounted on said base panel and spaced in the line of movement of said web.

10. The sign according to claim 7, wherein said base panel has hook-like tab means and wherein said web has corresponding receiving means for said tab means for releasably securing said base panel to the surface of said web.

11. The sign according to claim 7, wherein said base panel has opaque portions surrounding said display panel when it is mounted on the base panel for avoiding light leaks between the display panel and base panel.

12. The sign according to claim 7, wherein said sign has frame means in which said support means is received, said frame means having a viewing area in which said portion of said web extending between said rollers appears.

13. The sign according to claim 7, wherein said web, base panel, and display panel are formed of light transmitting material.

* * * * *